US007203996B2

(12) United States Patent
Linnenbrink et al.

(10) Patent No.: US 7,203,996 B2
(45) Date of Patent: Apr. 17, 2007

(54) HINGE DOOR ARRESTER FOR VEHICLE DOORS

(75) Inventors: Jörg Linnenbrink, Wuppertal (DE); Thomas Heiber, Velbert (DE)

(73) Assignee: Friedr. Fingscheidt GmbH, Velbert (DE)

( * ) Notice: Subject to any disclaimer, the term of this patent is extended or adjusted under 35 U.S.C. 154(b) by 173 days.

(21) Appl. No.: 10/380,443

(22) PCT Filed: Aug. 30, 2001

(86) PCT No.: PCT/EP01/10032

§ 371 (c)(1),
(2), (4) Date: Mar. 12, 2003

(87) PCT Pub. No.: WO02/23000

PCT Pub. Date: Mar. 21, 2002

(65) Prior Publication Data

US 2004/0020014 A1 Feb. 5, 2004

(30) Foreign Application Priority Data

Sep. 13, 2000 (DE) ..... 200 15 850 U

(51) Int. Cl.
*E05D 11/10* (2006.01)

(52) U.S. Cl. ..... 16/334; 16/82; 16/337

(58) Field of Classification Search ..... 16/334, 16/331, 332, 337, 82, 86 B; 296/146.9, 146.11, 296/146.12; 292/275, 262, 73, 75, DIG. 9
See application file for complete search history.

(56) References Cited

U.S. PATENT DOCUMENTS 2,992,451 A 7/1961 Schonitzer et al.
3,422,486 A * 1/1969 Thomas, Jr. ..... 16/251
3,874,028 A * 4/1975 Ernst et al. ..... 16/276
4,090,273 A 5/1978 Hurst, Jr.
4,953,259 A 9/1990 Frye et al.
5,173,991 A 12/1992 Carswell (Continued)

FOREIGN PATENT DOCUMENTS

DE 1 279 506 10/1968

(Continued)

*Primary Examiner*—Chuck Y. Mah
(74) *Attorney, Agent, or Firm*—Price, Heneveld, Cooper, DeWitt & Litton, LLP

(57) ABSTRACT

The invention relates to a hinge door arrester, particularly for vehicle doors, comprised of two hinge parts (2, 4), which are connected by a hinge pin (6) in a manner that permits them to swivel about a rotational axis (8) and between which a detent device (10) is integrated that defines different relative rotating positions. Said detent device (10) is comprised of at least one detent element (12), which is kinematically joined to the first hinge part (2) and which is spring-loaded in a radical working direction that is perpendicular to the rotational axis (8). The detent device is also comprised of a sliding surface (16), which is kinematically joined to the second hinge part (4), is provided essentially in the shape of a sector of a circle, is arranged, with regard to its radius of curvature, coaxial to the rotational axis (8), and which comprises at least one detent position (14) that interacts with the detent element (12). The detent element (12) is provided as a sliding friction over the sliding surface (16), whereby metal and plastic preferably interact in a sliding manner at all times.

15 Claims, 7 Drawing Sheets

U.S. PATENT DOCUMENTS

Figure 1:
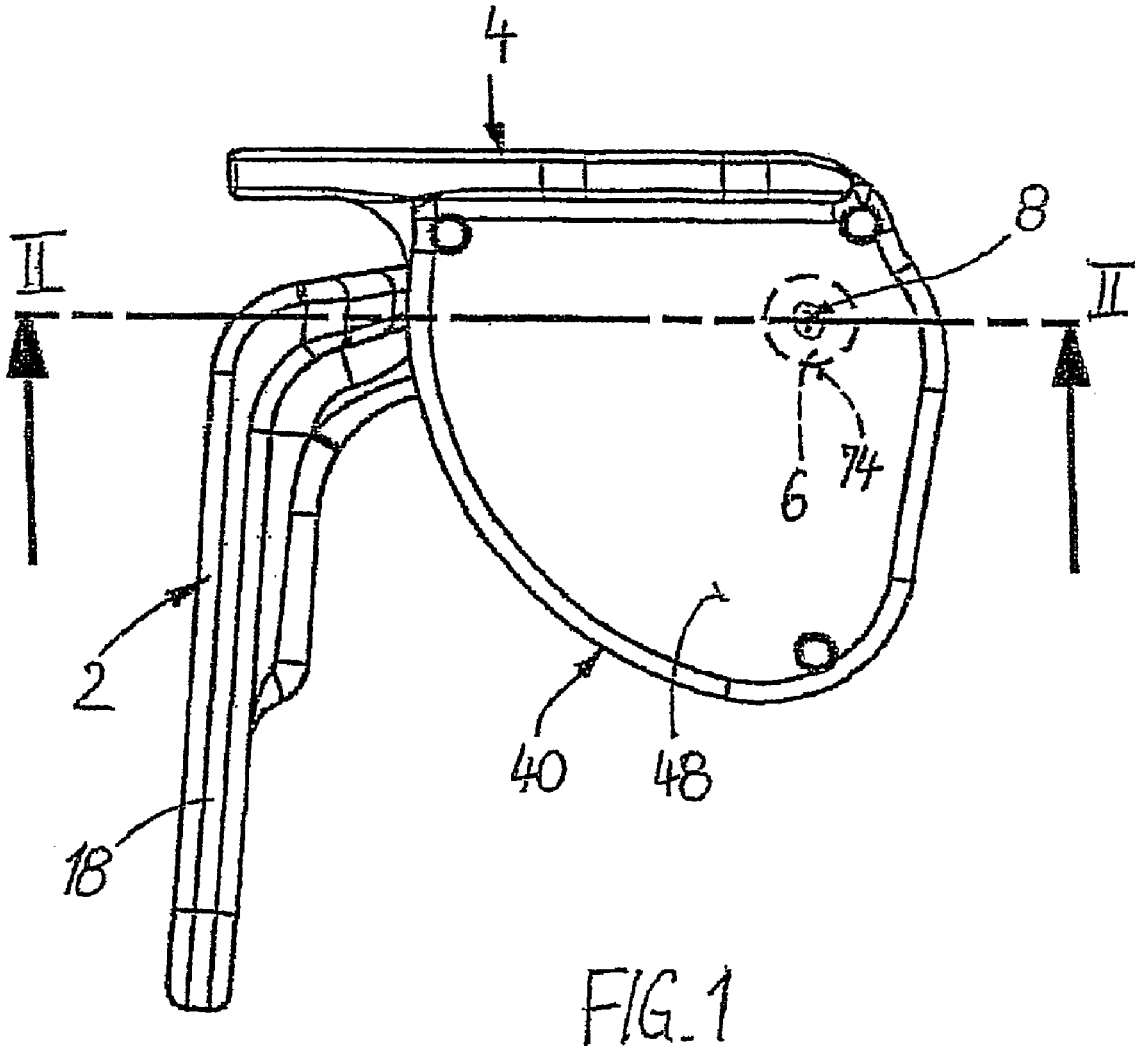

| | | | | |
|---|---|---|---|---|
| 5,452,501 | A * | 9/1995 | Kramer et al. | 29/11 |
| 5,685,046 | A | 11/1997 | Neag et al. | |
| 5,862,570 | A * | 1/1999 | Lezuch et al. | 16/82 |
| 5,918,347 | A * | 7/1999 | Morawetz | 16/322 |
| 5,920,960 | A * | 7/1999 | Kluting | 16/334 |
| 6,012,201 | A * | 1/2000 | Mitts et al. | 16/334 |
| 6,073,308 | A | 6/2000 | Linnenbrink et al. | |
| 6,349,448 | B1 | 2/2002 | Breed et al. | |
| 6,353,968 | B1 | 3/2002 | Shyu et al. | |
| 6,467,126 | B1 * | 10/2002 | Yezersky et al. | 16/86 C |
| 6,581,243 | B2 * | 6/2003 | Parizel | 16/334 |

FOREIGN PATENT DOCUMENTS

| | | | |
|---|---|---|---|
| DE | 4311907 | | 12/1993 |
| DE | 9314325 | | 3/1995 |
| DE | 4426425 | | 3/1996 |
| DE | 29611580 | | 1/1997 |
| DE | 29914042 | U1 * | 12/1999 |
| DE | 19829503 | | 3/2000 |
| DE | 19909500 | A1 * | 9/2000 |
| EP | 0893565 | | 1/1999 |
| EP | 930412 | A1 * | 7/1999 |
| EP | 1167671 | A1 * | 1/2002 |
| FR | 2705389 | A1 * | 11/1994 |
| WO | WO9942689 | | 8/1999 |
| WO | WO 32896 | A1 * | 6/2000 |

* cited by examiner

HINGE DOOR ARRESTER FOR VEHICLE DOORS

CROSS-REFERENCE TO RELATED APPLICATION

This application is the National Phase of PCT Application No. WO 02/23000 filed PCT on Aug. 30, 2001, which claims priority to German Utility Model Application No. 200 15 850.3 filed Sep. 13, 2000 and U.S. application Ser. No. 09/716,056 filed Nov. 17, 2000.

The present invention relates to a hinged door arrester, in particular for vehicle doors, comprising two hinge parts which are connected in a manner such that they can pivot about an axis of rotation by means of a hinge pin and between which is integrated a latching device defining various relative positions of rotation, the latching device first comprising at least one latching element which is connected kinematically to the first hinge part and is spring-loaded in a radial direction of action perpendicular to the axis of rotation, and secondly comprising a runway which is connected kinematically to the second hinge part, is essentially in the form of a sector of a circle and, with regard to its radius of curvature, is arranged coaxially to the axis of rotation and has at least one latching point interacting with the latching element.

A hinged door arrester of this type, i.e. a "door hinge having an integrated door arrester", is described in the document EP 0 893 565 A2. It is firstly characteristic of this type that the pivoting axis of the latching element of the door arrester corresponds to the axis of rotation of the hinge, and secondly that a runway merely extending over part of a circle (sector of a circle) is provided. This results in a very compact design. In the known hinged door arrester, the latching element (or each of a plurality of latching elements) is designed as a roller, roll or similar rotating rolling body which is mounted, via a bearing-spindle element, in a manner such that it can rotate about a rotational axis parallel to the axis of rotation of the hinge. In this connection, it is also to be ensured, by means of specific measures in the region of the interacting surfaces of the runway and of the latching element resting on the runway, that the rolling body in each case rolls along the runway so as to avoid any sliding friction and wear resulting therefrom. However, the rotational bearing arrangement of the rolling body or of each rolling body results in a relatively high outlay, which is disadvantageous especially because door arresters of this type are mass-produced products and so even only a relatively slight additional cost per piece results overall in serious additional costs.

The invention is based on the object of providing a hinged door arrester of the type mentioned, which is distinguished by a refinement which, in terms of structure and production, is particular simple and of good value and at the same time has good performance and endurance properties.

According to the invention, this is achieved in that the latching element is designed as a sliding element guided over the runway with sliding friction. The invention therefore fundamentally differs from the specification known from the prior art and it is thereby advantageously possible to omit complicated rotational bearings in the region of the latching element. It is nevertheless possible to obtain good performance properties and also long endurance, in a manner which is virtually free of maintenance. This has to be regarded as surprising, since the latching elements of door arresters of this type are acted upon by very high spring forces in order to ensure high latching and door-arresting moments. In this respect, the invention is based on the realization that—especially with certain combinations of material and/or shapings in the region of the sliding surfaces of the runway (slideway) and sliding element—it is possible still to obtain sufficiently low sliding friction that overall good performance properties and, surprisingly, also long endurance can be ensured. For this purpose, it is expedient to form one of the two interacting sliding surfaces from a metal and to form the other sliding surface from a suitable plastic (metal/plastic pairing), where the allocation of the materials to the sliding element and the slideway is actually as desired. Particularly suitable plastics are: PPA, PES, PEI, PPS, PA or PEEK. It is advantageous, for example, to configure the runway in the region of its runway surface of a polyamide with a lubricant additive, in particular molybdenum sulfite (for example, PA6 $MOS_2$), the sliding element, in the region of its sliding surface, consisting of a sintered metal, preferably with a lubricant diffused into it. Alternatively, the runway can consist of aluminum and the sliding element of plastic, for example the abovementioned polyamide. The essential feature here is for at least one of the "sliding partners" always to consist of a suitable plastic for the purpose of isolating sound.

Further advantageous refinement features of the invention are found in the subclaims and in the description which follows.

Figure 3:
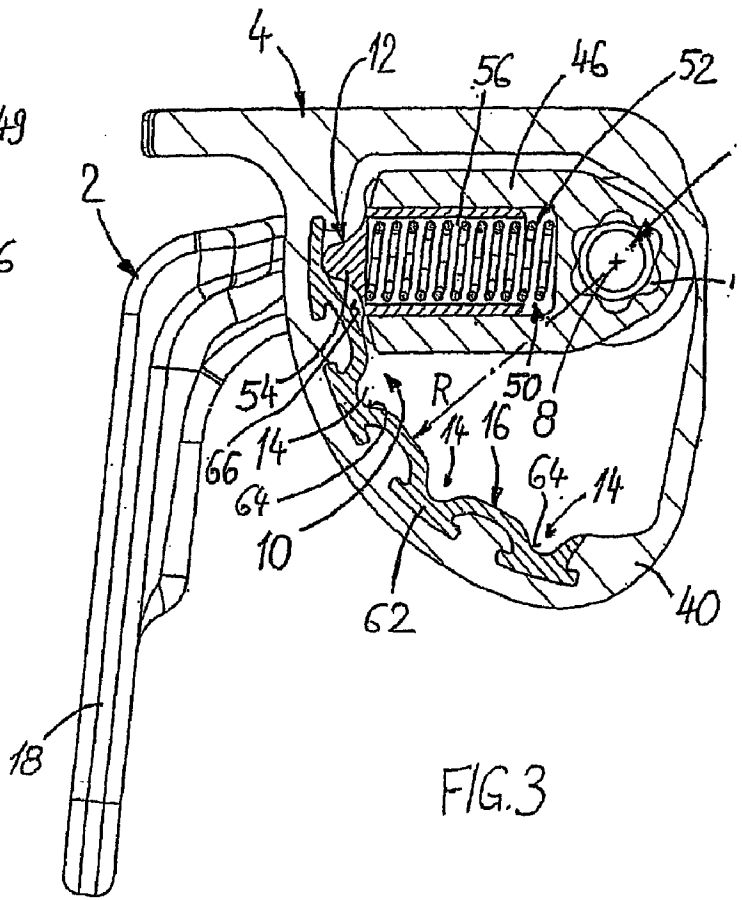
Figure 2:
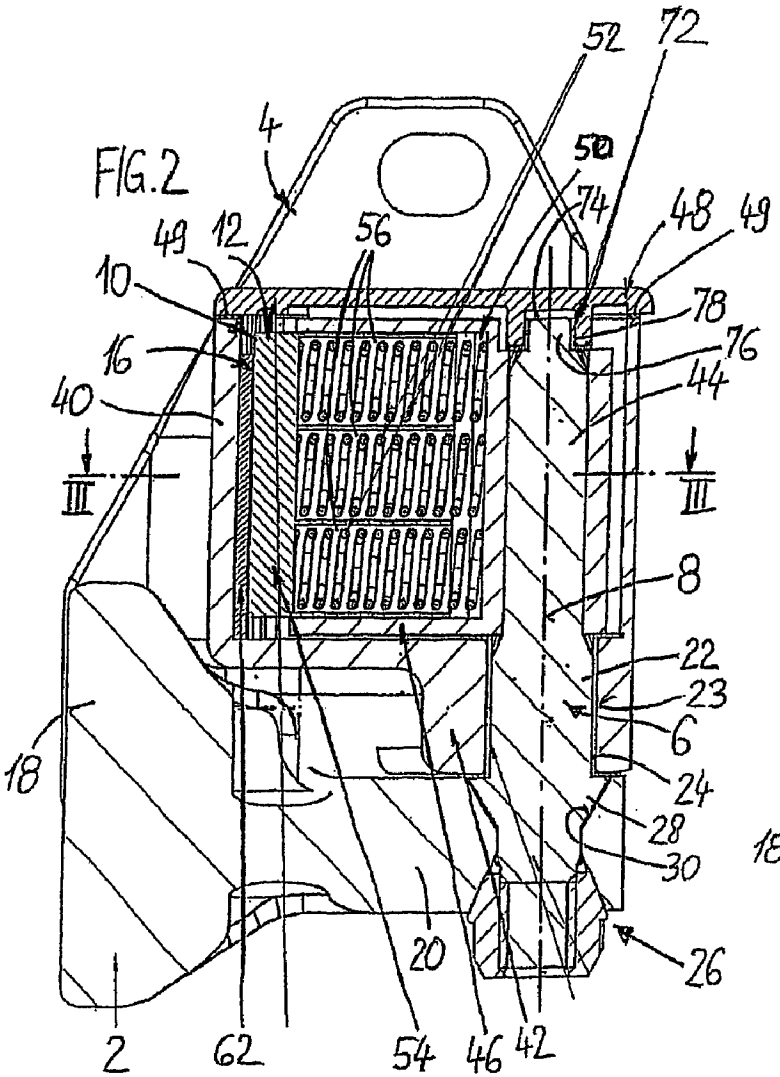
Figure 4:
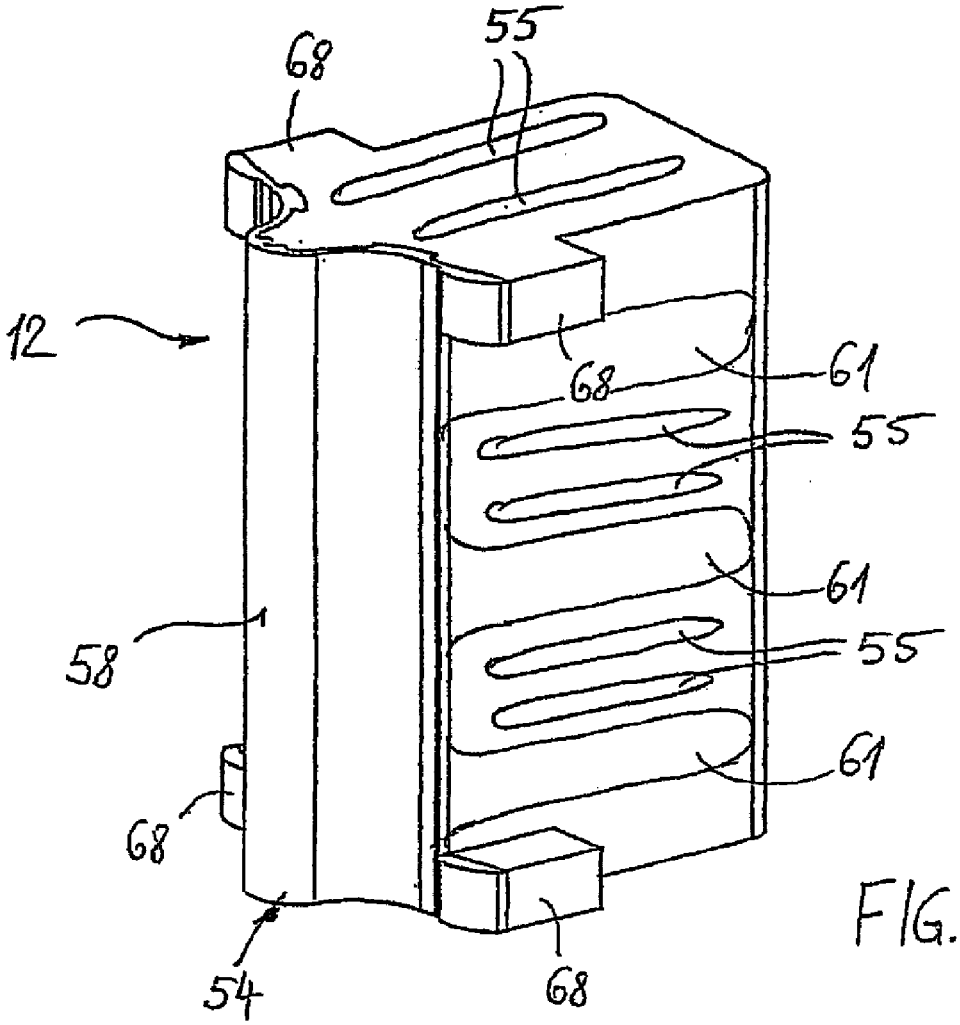
Figure 5:
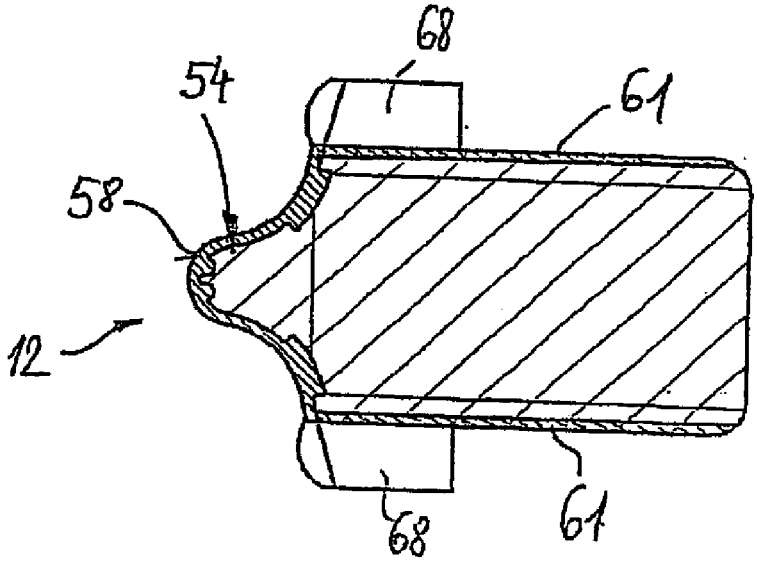
Figure 6:
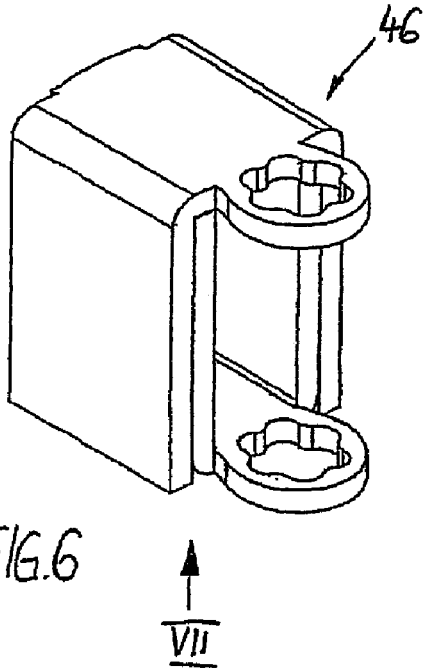
Figure 7:
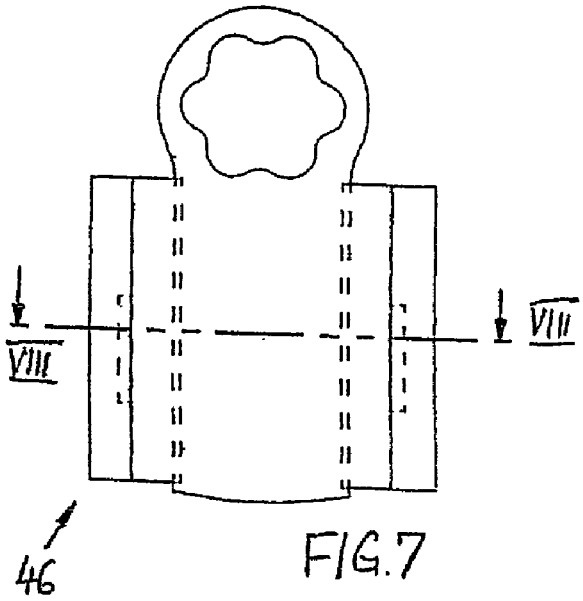
Figure 8:
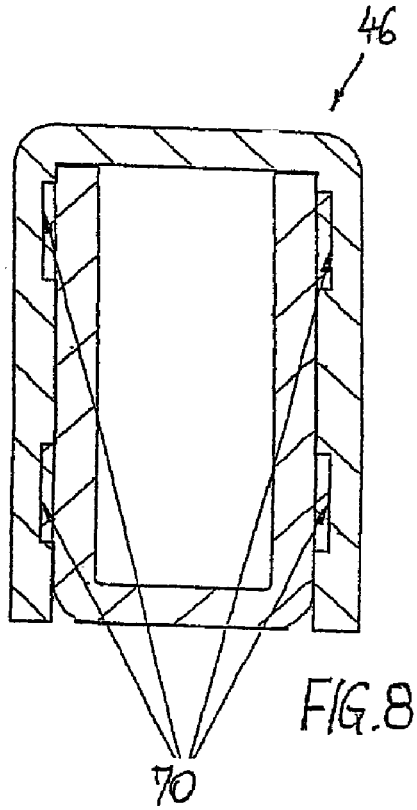
Figure 12:
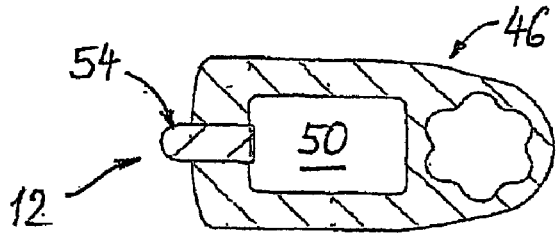
Figure 11:
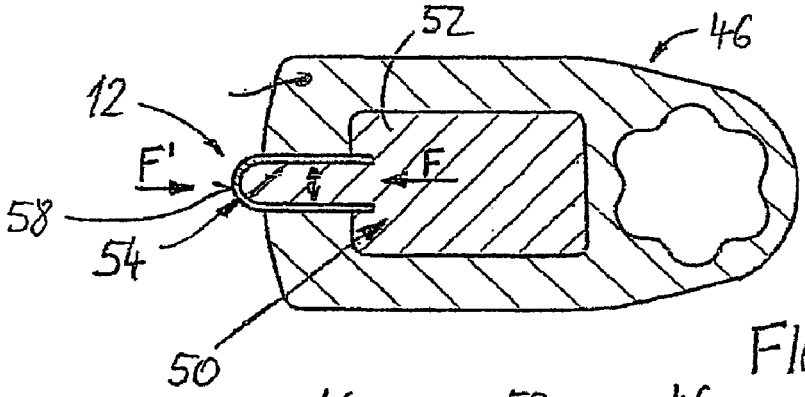
Figure 10:
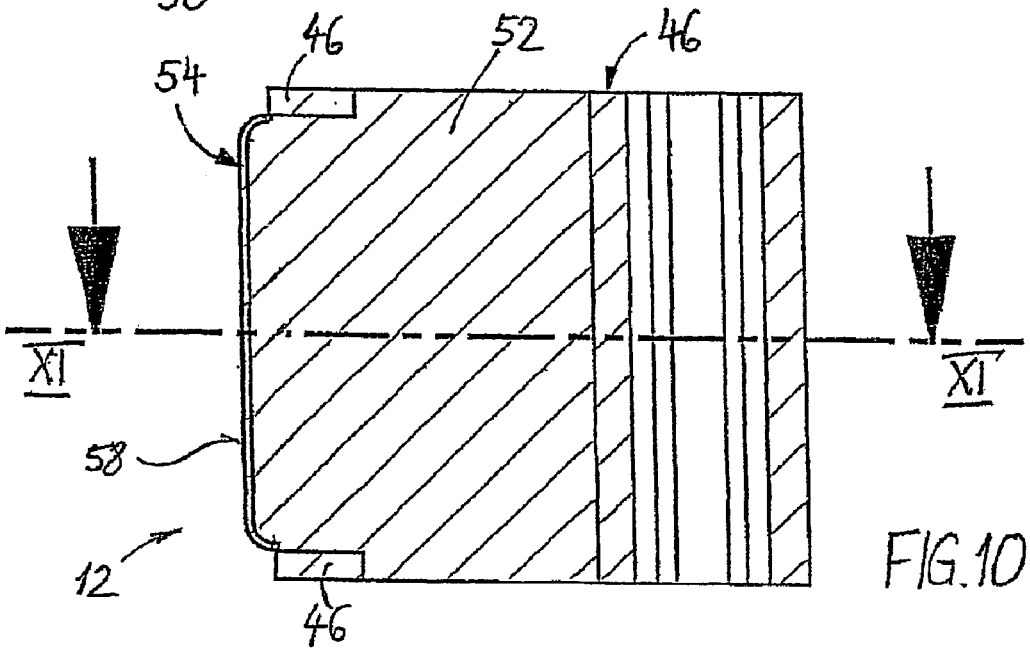
Figure 9:
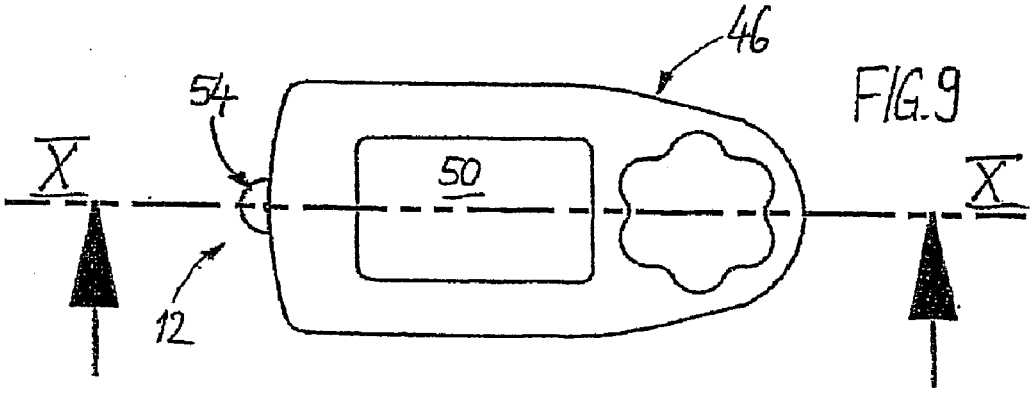
Figure 13:
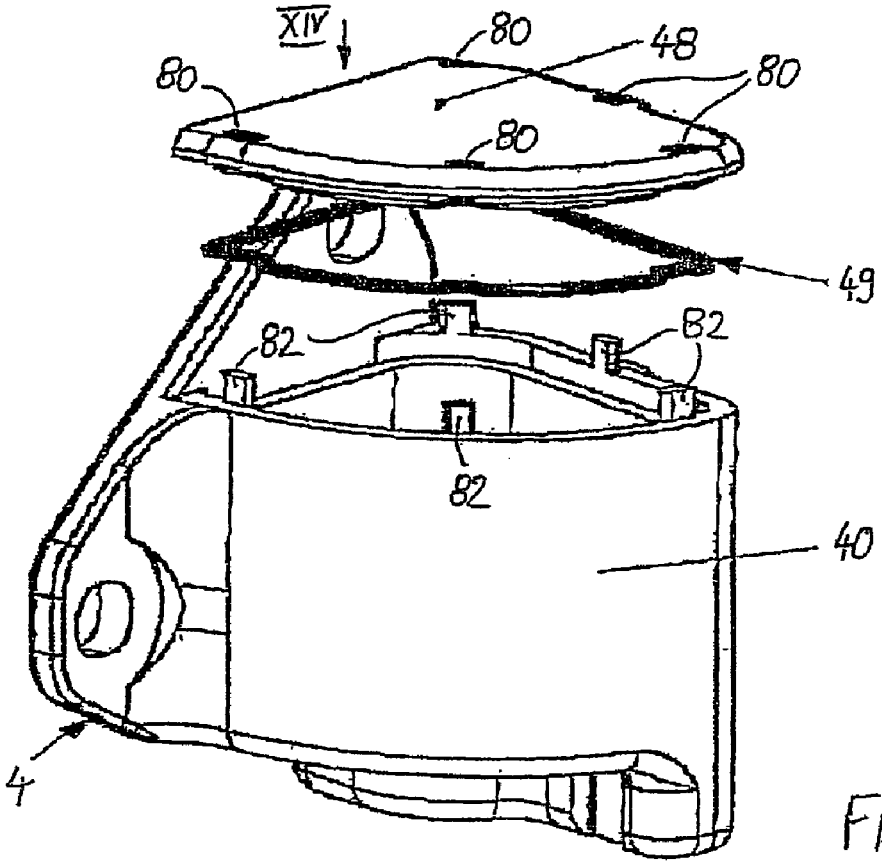
Figure 14:
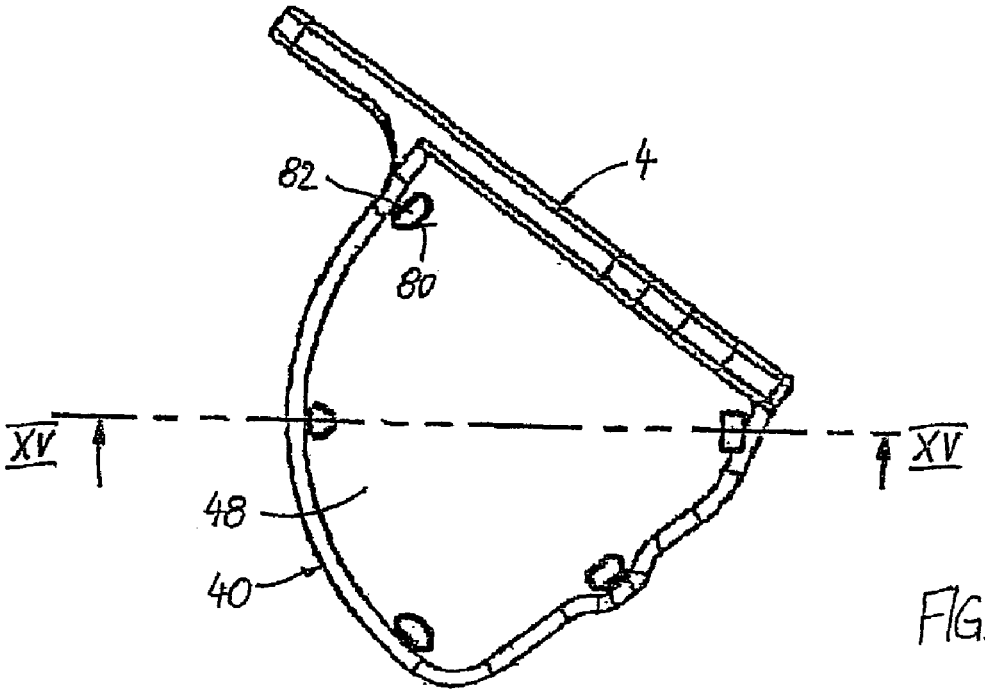
Figure 16:
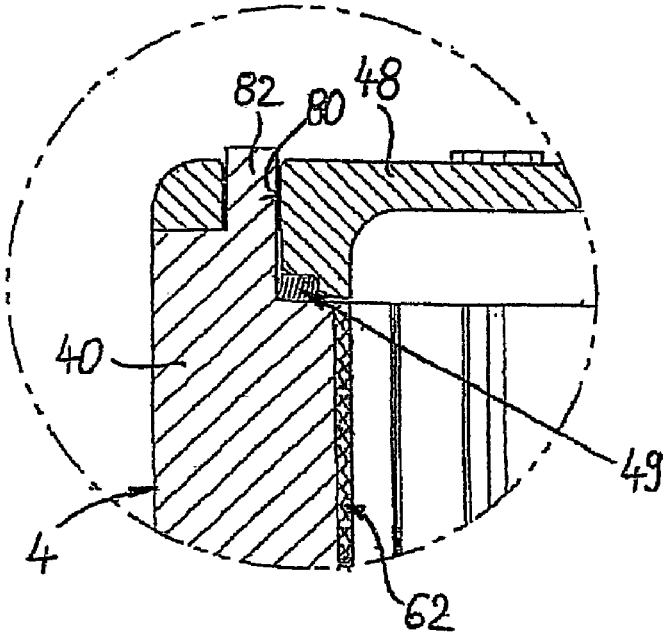
Figure 15:
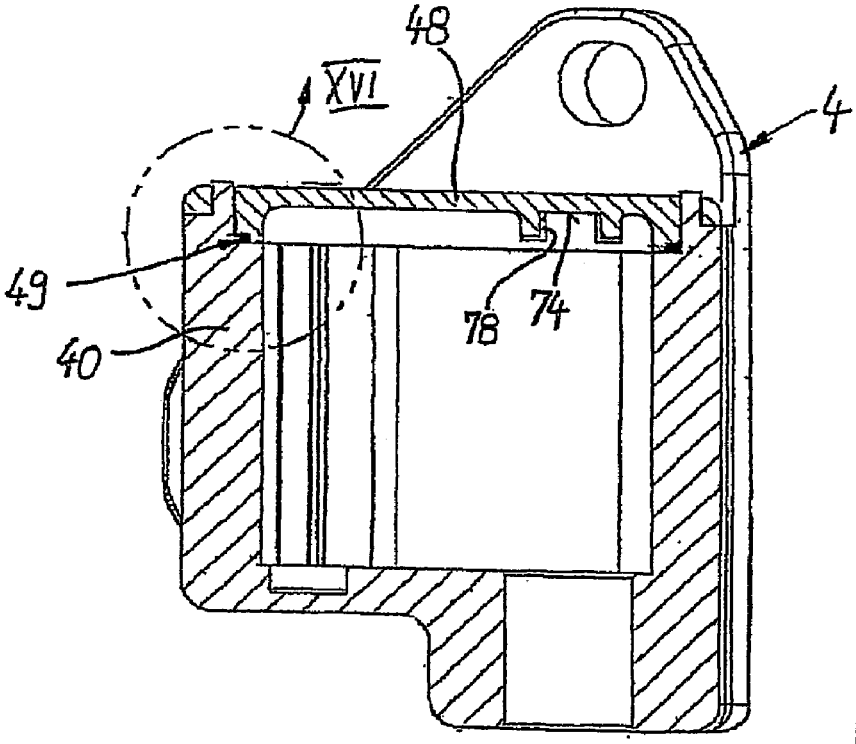

The invention will be explained more precisely with reference to preferred embodiments of a hinged door arrester according to the invention, which embodiments are illustrated in the drawing, in which:

FIG. 1 shows a door arrester according to the invention in a view (plan view) in the direction of the axis of rotation of the hinge, FIG. 2 shows an enlarged axial section in the plane II—II according to FIG. 1, FIG. 3 shows a cross section in the plane III—III according to FIG. 2, FIG. 4 shows a separate, enlarged perspective view of a sliding element in a first embodiment, FIG. 5 shows a cross section of the sliding element according to FIG. 4, FIG. 6 shows a perspective view of one possible design of a guide part for the sliding element, FIG. 7 shows an axial view of the guide part in the direction of the arrow VII according to FIG. 6, FIG. 8 shows a cross section in the plane VIII—VIII according to FIG. 7, FIG. 9 shows an axial view of a further embodiment of a guide part with the sliding element inserted, FIG. 10 shows an axial section in the plane X—X according to FIG. 9, FIG. 11 shows a cross section in the plane XI—XI according to FIG. 10, FIG. 12 shows a view analogous to FIG. 11, but on a reduced scale, together with a design variant of the sliding element, FIG. 13 shows a perspective view of one of the hinge parts in a preferred refinement, FIG. 14 shows a plan view in the arrow direction XIV according to FIG. 13, FIG. 15 shows a section in the plane XV—XV according to FIG. 14, and FIG. 16 shows an enlargement of the region XVI in FIG. 15.

In the various figures of the drawing, identical parts are always provided with the same reference numbers and are therefore generally also only described once in each case.

As ensues first of all from FIGS. 1 to 3, a hinged door arrester according to the invention comprises a first hinge part 2 and a second hinge part 4. The two hinge parts 2, 4 are connected to each other in a manner such that they can pivot about an axis of rotation 8 by means of a hinge pin 6. Integrated between the hinge parts 2, 4 is a latching device 10 which defines various relative positions of rotation. For this purpose, the latching device 10 firstly comprises at least one latching element 12 which is connected kinematically to the first hinge part 2 and is spring-loaded in a direction of action perpendicular to the axis of rotation 8, and secondly comprises a runway 16 which is connected kinematically to the second hinge part 4, is essentially in the form of a sector of a circle and, with regard to its radius of curvature, is arranged coaxially to the axis of rotation 8 (cf. FIG. 3) and has at least one latching point 14 interacting with the latching element 12.

The first hinge part 2 comprises a mounting section 18, with which the first hinge part 2 can be fastened to a mounting surface, which in particular is vertical, and also comprises a supporting section 20 (FIG. 2) which protrudes in the manner of a cantilever and is connected to the second hinge part 4 via the hinge pin 6. The hinge pin 6 extends from the supporting section 20 of the first hinge part 2 in just one direction, specifically preferably vertically upward. In this region, the second hinge part 4 sits rotatably on the hinge pin 6. For this purpose, the hinge pin 6 has a bearing section 22 which, in particular, is cylindrical and extends through a rotational-bearing opening 23 in the second hinge part 4. A sliding bushing 24 is expediently arranged within the rotational-bearing opening 23. In its end region adjoining the bearing section 22, the hinge pin 6 is connected to the latching element 12 in a manner locked with respect to torque. The hinge pin 6 therefore transmits forces or torques, with the result that it not only acts as an axis, but also as a shaft.

According to FIG. 2, the hinge pin 6 is preferably connected releasably to the first hinge part 2 or to the supporting section 20 thereof via connecting means 26, so that the hinge parts 2 and 4 can be separated, i.e. disassembled, by releasing these connecting means 26 while maintaining the connection between the hinge pin 6 and the second hinge part 4 or the latching means assigned to the second hinge part 4. In this connection, it is advantageously also provided that the connecting means 26 are designed in such a manner that within the maximum possible pivoting range (approximately 70° to 80°) of the hinge parts 2, 4, the hinge pin 6 can be connected to the first hinge part 2, in a manner locked with respect to torque, in only one specific relative position with respect thereto ("phase angle"<door-pivoting angle). For this purpose, the hinge pin 6 sits, by means of a preferably tapering section 28, in a correspondingly matched holder 30 of the supporting section 20 of the first hinge part 2 in a manner such that it is free of play, is self-centering and secured against twisting. The section 28 of the hinge pin 6 has a cross section which deviates from the circular form so as to ensure that the connection is secure against twisting. In the exemplary embodiment illustrated, there is an essentially conical configuration of the section 28 with a circular base cross section and with a cross-sectional widening formed, for example, by means of a radial rib. As an alternative to this, the section 28 of the hinge pin 6 could also, for example, have a polygonal cross section or a circular base cross section with at least one cross-sectional reduction formed, for example, by means of a secant-like region.

As now further ensues from each of FIGS. 1 to 3, the latching device 10 is accommodated within a housing 40, which is preferably formed integrally with the second hinge part 4. According to FIG. 2, the hinge pin 6 engages in the housing 40 through a wall 42 which is approximately parallel to the supporting section 20 of the first hinge part 2 and has the rotational-guide opening 23 preferably together with the sliding bushing 24. Arranged within the housing 40 is firstly the runway 16, which is fixed in position with respect thereto, and secondly a guide part 46 which guides the latching element 12 and is connected to a connecting section 44 of the hinge pin 6 in a manner locked with respect to torque. For the connection which is locked with respect to torque, the connecting section 44 has a cross section which deviates from the circular form, in the example illustrated a rounded polygonal or star-shaped cross section (cf. FIG. 3). On its upper side facing away from the wall 42, the housing 40 has an opening which serves for the fitting of the functional parts of the latching device 10 and can be closed by means of a cover element 48 (FIGS. 1 and 2)—preferably sealed via a suitable seal 49. The latching element 12 is guided displaceably in the guide part 46 in a direction which is perpendicular and radial to the axis of rotation 8, and is acted upon radially from the inside in the direction of the runway 16 arranged on the outside by spring force F from an energy storing device 50. The energy storing device 50 is formed by at least one spring element 52. A helical compression spring, a rubber or elastomeric element, a cup spring and/or the like, for example, can be used as the spring element 52. In the exemplary embodiment according to FIGS. 2 to 5, the latching element 12 is acted upon by three spring elements 52 which are designed as helical compression springs and are each arranged next to or above one another in the direction of the axis of rotation 8. The number of spring elements 52 and the level of spring force F in each case depend on the latching or arresting moments to be obtained.

The invention now makes provision for the latching element 12 to be designed as a sliding element 54 guided over the runway 16 with sliding friction.

In the first embodiment shown in FIGS. 2 to 5, the sliding element 54 is an approximately cuboidal body which is guided displaceably over a large, radial length in a correspondingly shaped interior of the guide part 46. For this purpose, it is advantageous if—see FIG. 4—the sliding element 54 has, in the region of its surfaces guided in the guide part 46, groove-like depressions 55 for holding a lubricant (for example, grease). In this arrangement, the sliding element 54 according to FIG. 2 has a spring holder 56, which is especially in the manner of a blind hole, for each spring element 52, so that each spring element 52 arranged within the guide part 46 engages by a relatively large length in the associated spring holder 56 of the sliding element 54. This advantageous configuration results in a large loaded length of spring with the sliding element 54 having a guide length which is large and therefore more secure against tilting, and all in all, advantageously, in a low overall size.

By means of a front sliding surface 58, as it moves the sliding element 54 interacts with a slideway surface 60 of the runway 16 with sliding friction. According to the invention, in the regions of the sliding surface 58 and of the slideway surface 60 use is made of materials or pairs of materials enabling low coefficients of friction to be achieved.

A metal/plastic pairing is expediently involved in each case in such a manner that metal and plastic always interact with sliding friction. The following may be mentioned as an exemplary example of plastics which interact, with advantageously low sliding friction, with a metal, which is basically as desired:

PPA=Polyphthalamide
PES=Polyethersulfone
PEI=Polyetherimide
PPS=Polyphenyl sulfide
PA (Polyamide; in particular PA 6,6 with 40% carbon fibers)
PEEK=Polyetheretherketone Further suitable materials emerge from the following table:

| | Sliding element 54 (sliding surface 58) | Runway 16 (slideway surface 60) | Guide part 46 and/or housing 40 |
|---|---|---|---|
| Material | Steel (hard)<br>Sintered metal<br>Plastic<br>(in particular 2-component technique) | Aluminum die casting alloy<br>Alloy (in particular based on aluminum) capable of being thixotropic<br>Plastic<br>Steel (hard)<br>Steel (soft) | Steel (hard)<br>Sintered metal<br>Hard anodized aluminum<br>Steel (soft) |
| Production method | Extrusion<br>Casting,<br>Plastic 2-component method | Casting<br>Forging<br>Deep-drawing<br>Injection molding | Extrusion<br>Follow-on composite tool sintering |

The materials mentioned for the corresponding components can in principle be used in any desired or suitable combination with one another. However, in the following, more specifically, advantageous combinations of material are given as preferred examples.

It is provided as a variant in FIGS. 9 to 12 that a block-like elastomeric element, which is provided as a spring element 52, substantially fills an interior of the guide part 46 and in the process acts counter to the sliding element 54. According to FIGS. 10 and 11, the sliding element 54 in this case is designed as a hollow body, which is open on its side facing away from the runway 16 or its sliding surface 58, in such a manner that it can be expanded, by being acted upon by the spring force F, in order to eliminate play within a shaft-like guide section of the guide part 46. This is shown in FIG. 11 by a small double arrow. The spring force F or the counter bearing force F' causes the elastomeric material of the spring element 52 to be compressed in the radial direction in such a manner that said material elongates transversely with respect to said force and acts from the inside, in the direction of the small double arrow, on the hollow sliding element 54 and brings the latter to bear fixedly in the guide part 46 (elimination of play). In the specific design, the sliding element 54 is formed by an open U-profiled piece which, by means of its U-bow, forms the sliding surface 58, which acts counter to the runway 16, and in which the elastomeric spring element 52 engages, so that the spring force F also causes the expansion of the U-profiled piece, by means of a corresponding lateral extension of the elastomeric spring element 52.

In the design variant shown in FIGS. 4 and 5, the sliding element 54 is formed by a two-component plastic shaped part. In this case, the region of the sliding surface 58 can advantageously consist of a first plastic material and the remaining region of a second, different plastic material. A material having good (low-friction) sliding properties is used for the region of the sliding surface 58. The mechanical stability is of prime importance in the remaining region because of being acted upon by the spring. The two material components are then connected to each other with a cohesive material joint and/or homogeneously and/or in a form-fitting manner. In this arrangement, in addition to or alternatively to the grease-containing depressions 55 already described above—the surfaces guided in the guide part 46 may have, at least in some regions, for example in the lifting direction of movement, as illustrated, strip-shaped coatings 61 made of a material with good sliding properties, advantageously, for example made of the same material as the sliding surface 58. Zones for accommodating lubricant (for example, grease) are produced between the strip-shaped coatings 61.

As furthermore ensues in particular from FIG. 3, the runway 16 is preferably formed by an insert part 62 supported in the housing 40. This insert part 62 may advantageously also be supported in the housing 40 with a cohesive material joint and/or in a form-fitting manner. The material of the insert part 62 is preferably injected into the housing 40. The insert part 62 is thereby supported in particular in a nonreleasable manner. However, as an alternative to this provision may also be made for the insert part 62 to be supported in a releasable manner and, by this means, in an interchangeable manner in the housing 40.

The runway 16 preferably has a plurality of latching points 14 which are each formed as latching depressions 64 with a contour matching the sliding element 54. As illustrated, these are preferably concave latching depressions 64, the sliding element 54 being curved in a correspondingly convex manner in the region of its sliding surface 58.

During the relative movement of the hinged parts 2, 4 the sliding element 54 latches in each case into a latching depression 64. In this connection, the position of the latching depressions 64 is selected in particular in such a manner that a completely opened opening position of the vehicle door and preferably, in addition, at least one, for example, approximately semiopened intermediate position (so called parking position) are defined. In addition, it is preferably provided that the latching device 10 defines a pulling path for automatically shutting the vehicle door in an end region of the relative movement, which region is assigned kinematically upstream of a door-closing position. For this purpose, the runway 16—see again FIG. 3 in particular—has, in its end region arranged upstream of the door-closing position, a pulling-path section 66 which runs from a certain, smaller radius of the runway obliquely outward to larger radius. By means of this oblique profile of the runway 16 over the pulling-path section 64, the spring force F, via the sliding element 54, is able to cause automatic rotation of the hinge part, which is connected to the door, as far as the door-closing position.

The insert part 62 forming the runway 16, particularly when it is able to be released and interchanged, can be supported in the housing 40 via a form-fitting connection. The connection is designed in such a manner that it gives a rigid, positionally fixed support, in particular in the direction of movement of the sliding element 54. The connections can expediently be dovetail-like or T-groove connections. Being able to interchange the runway 16 or the insert part 62 makes simple and rapid adaptation to different requirements possible. For example, the hinged door arrester can be configured for different latching positions and/or latching forces/moments. In addition, a possibility for simple and rapid maintenance is provided.

With regard to the sliding element 54, it should furthermore be mentioned that in the cuboidal design, for example according to FIGS. 4 and 5, guide projections 68 are arranged, in particular in the four corner regions, said guide projection 68 lying outside the guide part 46 in such a manner that a movement of the sliding element transversely with respect to its actual direction of action is largely prevented.

The guide part 46 may be an integral shaped part made of metal or plastic. In the variant according to FIGS. 6 to 8, the guide part 46 is composed of two sheet-metal punched bent parts, each bent part being approximately U-shaped. The two parts then intermesh by means of parallel leg sections which, according to FIG. 8, are connected to each other via welds 70.

Finally, as far as the variant according to FIG. 12 is concerned, the sliding element 54 is formed here by a strip-shaped solid profile—expediently as a replacement for the hollow profile according to FIGS. 10 and 11. Said solid profile can basically be acted upon by at least one desired type of spring element, for example by helical springs to the effect of the design according to FIGS. 2, 3.

In the exemplary embodiment illustrated according to FIGS. 1 to 3, the two hinge parts 2 and 4 are each designed as an integral shaped part, in particular made of a light metal die casting (aluminum die casting) or as a pressed part or forged part. If a light metal die casting part does not meet the required values for strength, special methods, such as-vacuum die casting or vacural casting or else thixotropic casting are preferably to be used. These casting methods result in a more homogeneous structure which can be temper-hardened by heat treatment. This results in a maximum yielding point with a high elongation at break.

It should furthermore be mentioned that an end stop restricting the opening movement of the vehicle door is formed between the two hinge parts 2 and 4 by the two parts 2 and 4 directly bearing against each other via stop elements (not described in greater detail).

In the embodiment shown in FIGS. 1 to 3, the first hinge part 2 is provided for fastening to a positionally fixed vehicle frame part (for example, pillar or post), while the second hinge part 4 can be fastened to the pivotable vehicle door.

Of course, a "kinematically reverse" design is also possible with the first hinge part 2 being assigned to the vehicle door and the second hinge part 4 being assigned to the positionally fixed vehicle part.

In a further advantageous refinement of the invention—see FIG. 2 in particular—it is provided that the hinge pin 6, in its upper end region lying axially opposite the fixed connection to the first hinge part 2, is also supported against lateral play movements relative to the second hinge part 4 via a counter bearing arrangement 72. This counter bearing arrangement 7 is a rotatable guide, in particular in the region of the cover element 48, for which purpose a bearing opening 74 in the housing cover 48 rotatably holds one bearing end 76 of the hinge pin 6—preferably via an additional bearing bushing 78. This advantageous measure avoids lateral play movements of the upper end region of the hinge pin 6, which movements could otherwise lead to corresponding, undesirable movements of the door in the latching positions.

As furthermore concerns the design according to FIGS. 13 to 16, here, according to FIG. 13, the seal 49, which has already been mentioned above, is designed as a separate, elastomeric sealing element which is clamped with a force fit between sealing surfaces of the housing 40 of the cover element 48. In this arrangement, the cover element 48 can advantageously additionally be placed onto projects 82 of the housing 40 for more accurate positioning with openings 80. In a first alternative of this sealing arrangement, provision can also be made to form the seal by injecting onto or into the cover element 48. The cover element 48 can consist of a plastic material, the seal 49 then being injected via a two-component technique (two-component injection molding method). A second variant would be to insert the hinge part 4 or the housing 40 into a plastic injection mold in order subsequently first to inject the insert part 62 with the runway 16 and then to inject the seal 49 in a second working step. In the alternatives mentioned, it is advantageously possible to omit a separate installation of the seal 49.

The refinement according to the invention gives, inter alia, the following substantial advantages:

compact design, low weight, low in noise or virtually free of noise, able to be removed and fitted simply and rapidly, sealed encapsulation of the latching device for protection against external influences during operation and, in particular, also against a possible dip coating during production. In addition, the fact that of an entire circle intentionally only a segment of a maximum of 90° is used for the runway 16, results in a very small overall size and the installation space available within the vehicle can be better used for the radius or levers of the latching elements. In this manner, a relatively large radius can be used, so that a high retaining moment can be achieved with relatively low spring force F. In the embodiment realized, a radius of movement (main radius R of the runway 16; see FIG. 3) of the latching elements 12 is provided in the region of approximately 30 to 35 mm. For a design which is as compact as possible, the lower value of approximately 30 mm is to be sought, in which case the spring force has to be made correspondingly higher so as to ensure the required latching moment. However, the latching moment can also be favorably influenced by a particular geometry in the region of the latching depressions 64, in particular by small transitional radii between each latching depression 64 and the adjacent region of the runway 16.

A maximized radius of action R which is still able to be realized in the available construction space in the region of motor-vehicle doors makes it possible, according to the invention, for the mechanical forces or influences to be selected within a limit range which only allows the use of plastic in the latching device (sliding) as the frictional partner. The advantageous result is a sliding door arrester system which is virtually free of noise and maintenance and meets the requirements and functional specifications of the motor vehicle industry. In contrast, smaller radii R would, because of excessive forces, rule out the use of plastic, so that increased noises would be caused because of having to use steel or other metals.

According to the invention, at least one of the two "sliding partners" interacting in each case therefore can always consist of a plastic material for the purpose of "refraction of sound" or "isolating of sound". It is particularly advantageous, for example, to configure the runway in the region of its runway surface of a polyamide with a lubricant additive, in particular molybdenum sulfite (for example, PA6 $MOS_2$), the sliding element, in the region of its sliding surface, consisting of a sintered metal, preferably with a lubricant diffused into it. The guide part can consist of, for example, extruded aluminum, for example F31, which may preferably be hard anodized as surface protection. The sliding element advantageously has a sliding radius of curvature of only approximately 2 mm. This also correspondingly applies to the radius of the latching depressions. Each latching depression merges via a transitional radius of, in particular, approximately 5 mm into the main radius R of the runway. Between the main radius R and the latching depressions the sliding element executes a radial movement stroke of preferably approximately 3 mm. A door-arresting moment of approximately 50 Nm can be achieved by the values mentioned by way of example.

In an advantageous alternative the following pairings of material can also be used:

Runway made of aluminum, in particular of an alloy capable of being thixotropic

Sliding element made of plastic, preferably PA6 $MoS_2$

Guide path as above.

The invention is not restricted to the exemplary embodiments illustrated and described, but also includes all designs acting in the same manner within the meaning of the invention. Furthermore, the invention up to now is also not restricted to the combination of features defined in claim 1, but may also be defined by any desired other combination of certain features of all of the individual features disclosed as a whole. This means that in principle virtually any individual feature of claim 1 can be omitted or replaced by at least one individual feature disclosed at another point in the application. To this extent, claim 1 is merely to be understood as a first formulation attempt for an invention.

The invention claimed is:

1. A hinged door arrester for vehicle doors, comprising:

a first hinge part and a second hinge part connected in a manner such that the hinge parts pivot about an axis of rotation by means of a hinge pin; and, a latching device located between the pair of hinge parts and defining various relative positions of rotation, the latching device comprising:

at least one latching element which is connected kinematically to the first hinge part and is spring-loaded in a radial direction of action perpendicular to the axis of rotation; and, a runway which is connected kinematically to the second hinge part and comprises a sector of a circle having a radius of curvature that is arranged coaxially to the axis of rotation and has at least one latching point interacting with the latching element, wherein the latching element includes a sliding element guided with sliding friction over the runway, the sliding element is biased in the radial direction within a guide part by a spring element, the latching device is accommodated within a housing coupled to the second hinge part, there being arranged within the housing the runway fixed in position with respect to the housing, the guide part is fixed to the hinge pin with respect to rotation, and wherein the spring element engages in a spring holder that comprises a blind hole in the sliding element.

2. A hinged door arrester for vehicle doors, comprising:

a first hinge part and a second hinge part connected in a manner such that the hinge parts pivot about an axis of rotation by means of a hinge pin; and, a latching device located between the pair of hinge parts and defining various relative positions of rotation, the latching device comprising:

at least one latching element which is connected kinematically to the first hinge part and is spring-loaded in a radial direction of action perpendicular to the axis of rotation; and, a runway which is connected kinematically to the second hinge part and comprises a sector of a circle having a radius of curvature that is arranged coaxially to the axis of rotation and has at least one latching point interacting with the latching element, wherein the latching element includes a sliding element guided with sliding friction over the runway, the sliding element is biased in the radial direction within a guide part by a spring element, the latching device is accommodated within a housing coupled to the second hinge part, there being arranged within the housing the runway fixed in position with respect to the housing, the guide part is fixed to the hinge pin with respect to rotation, and wherein the spring element comprises an elastomeric element that substantially fills an interior of the guide part.

3. The hinged door arrester of claim 2, wherein the sliding element comprises an open U-profiled piece having a U-bow acting counter to the runway, and wherein the spring element also causes an expansion of the U-profiled piece.

4. The hinged door arrester of claim 3, wherein the sliding element comprises a metal in the region a sliding surface of the sliding element that interacts with the runway.

5. The hinged door arrester of claim 3, wherein the sliding element includes a first region that comprises a first material, and a second region that comprises a second material different from the first material.

6. A hinged door arrester for vehicle doors, comprising:

a first hinge part and a second hinge part connected in a manner such that the hinge parts pivot about an axis of rotation by means of a hinge pin; and, a latching device located between the pair of hinge parts and defining various relative positions of rotation, the latching device comprising:

at least one latching element which is connected kinematically to the first hinge part and is spring-loaded in a radial direction of action perpendicular to the axis of rotation; and, a runway which is connected kinematically to the second hinge part and comprises a sector of a circle having a radius of curvature that is arranged coaxially to the axis of rotation and has at least one latching point interacting with the latching element, wherein the latching element includes a sliding element guided with sliding friction over the runway, and wherein the runway includes a plurality of latching points having latching depressions each having a contour matching the sliding element.

7. A hinged door arrester for vehicle doors, comprising:

a first hinge part and a second hinge part connected in a manner such that the hinge parts pivot about an axis of rotation by means of a hinge pin; and, a latching device located between the pair of hinge parts and defining various relative positions of rotation, wherein the hinge pin is releasably coupled to the first hinge part by a connecting means such that the first and second hinge parts may be separated by release of the connecting means while maintaining the connection between the hinge pin and the second hinge part and the latching device, the latching device comprising:

at least one latching element which is connected kinematically to the first hinge part and is spring-loaded in a radial direction of action perpendicular to the axis of rotation; and, a runway which is connected kinematically to the second hinge part and comprises a sector of a circle having a radius of curvature that is arranged coaxially to the axis of rotation and has at least one latching point interacting with the latching element, wherein the latching element includes a sliding element guided with sliding friction over the runway.

8. A hinged door arrester for vehicle doors, comprising:

a first hinge part and a second hinge part connected in a manner such that the hinge parts pivot about an axis of rotation by means of a hinge pin, wherein an end region of the hinge pin lying axially opposite the connection to the first hinge part is supported against lateral play movements relative to the second hinge part by a counter bearing arrangement, wherein the counter bearing includes a bearing opening in a housing cover, that holds one bearing end of the hinge pin in a rotatable manner; and, a latching device located between the pair of hinge parts and defining various relative positions of rotation, the latching device comprising:

at least one latching element which is connected kinematically to the first hinge part and is spring-loaded in a radial direction of action perpendicular to the axis of rotation; and, a runway which is connected kinematically to the second hinge part and comprises a sector of a circle having a radius of curvature that is arranged coaxially to the axis of rotation and has at least one latching point interacting with the latching element, wherein the latching element includes a sliding element guided with sliding friction over the runway.

9. A hinged door arrester for vehicle doors, comprising:

a first hinge part and a second hinge part connected in a manner such that the hinge parts pivot about an axis of rotation by means of a hinge pin; and, a latching device located between the pair of hinge parts and defining various relative positions of rotation, the latching device comprising:

at least one latching element which is connected kinematically to the first hinge part and is spring-loaded in a radial direction of action perpendicular to the axis of rotation; and, a runway which is connected kinematically to the second hinge part and comprises a sector of a circle having a radius of curvature that is arranged coaxially to the axis of rotation and has at least one latching point interacting with the latching element, wherein the latching element includes a sliding element guided with sliding friction over the runway, and wherein at least a portion of the sliding element located proximate the runway and at least a portion of the runway located proximate the sliding element comprise a metal/plastic pairing.

10. The hinged door arrester of claim 9, wherein the latching element comprises a hollow body open on a side facing away from the runway such that the latching element is expanded by a spring element thereby eliminating play within a guide section of the guide part.

11. The hinged door arrester of claim 9, wherein the runway comprises a metal in the region that the runway interacts with the sliding element, and wherein the sliding element comprises a low-friction plastic in the region that the sliding element interacts with the runway.

12. The hinged door arrester of claim 9, wherein the runway is formed by an insert part supported within a housing.

13. The hinged door arrester of claim 12, wherein the insert part is supported within the housing by a cohesive material joint.

14. The hinged door arrester of claim 9, wherein the sliding element is guided within a guide part, and wherein the guide part.

15. The hinged pin door arrester of claim 9, wherein the latching device is accommodated within a housing that is closed in a region of a housing opening by a housing cover, and wherein the housing is seated with respect to the housing cover via a seal.

* * * * *